United States Patent [19]

Heimberger

[11] 4,411,211

[45] Oct. 25, 1983

[54] METHOD OF AND APPARATUS FOR ATTACHING SLIDE FASTENER COUPLING CHAINS TO A FLEXIBLE SUPPORT

[75] Inventor: Halmüt Heimberger, Steinhausen, Switzerland

[73] Assignee: Optilon W. Erich Heilmann GmbH, Cham, Switzerland

[21] Appl. No.: 314,047

[22] Filed: Oct. 22, 1981

[30] Foreign Application Priority Data

Oct. 25, 1980 [DE] Fed. Rep. of Germany ..... 3040286

[51] Int. Cl.[3] ..... D05B 97/10; D05B 29/06; D05B 27/04

[52] U.S. Cl. ..... 112/265.2; 112/130; 112/235; 112/323

[58] Field of Search ..... 112/265.2, 262.1, 235, 112/130, 323

[56] References Cited

U.S. PATENT DOCUMENTS 3,793,969 2/1974 Adams ..... 112/235
3,858,538 1/1975 Van Amburg ..... 112/235
3,859,939 1/1975 Howell ..... 112/235
4,321,880 3/1982 Boser ..... 112/235

FOREIGN PATENT DOCUMENTS 2326421 12/1973 Fed. Rep. of Germany ..... 112/235
2811834 9/1978 Fed. Rep. of Germany ..... 112/235

*Primary Examiner*—H. Hampton Hunter
*Attorney, Agent, or Firm*—Karl F. Ross

[57] ABSTRACT

A method of and a sewing machine for affixing a continuous chain of coupling members for a slide fastener to a flexible support, e.g. a garment or a tape to be applied to a garment, utilizes a fabric fed by a mechanism below the worktable and a presser foot with a feeder above the worktable which advances the coupling chain in a composite movement including up-and-down and back-and-forth components. According to the invention, at least one of the drives is adjustable so that the increment of the displacement of the respective member (fabric or coupling chain) can be varied to ensure that the two members are stitched together free from undulations or corrugations after the stitching operation or any subsequent treatment to which the product may be subjected.

10 Claims, 9 Drawing Figures

METHOD OF AND APPARATUS FOR ATTACHING SLIDE FASTENER COUPLING CHAINS TO A FLEXIBLE SUPPORT

FIELD OF THE INVENTION

My present invention relates to the stitching of slide fastener coupling chains to flexible supports and especially fabric supports and particularly to a method and apparatus capable of sewing the coupling chain onto an edge of the support such that the stitches pass between the coupling heads in traversing the support.

BACKGROUND OF THE INVENTION

Although slide fasteners represent a highly developed art, for the most part they are composed of certain basic elements which can be easily described. A typical slide fastener thus may have a coupling chain or coupling element formed with a row of spaced-apart coupling heads adapted to interdigitate with the coupling heads of an opposing row upon movement of a slider along these rows, the slider serving to bring about the interengagement of the coupling heads of the two rows or the disengagement thereof, depending upon the direction in which the slider is moved.

The coupling head may be shaped to fit between the coupling heads of the opposing row and to engage therebehind to lock the two rows together until the slider is moved along these rows in a fastener-opening manner.

The coupling chains may be fabricated from a continuous member, e.g. a synthetic resin monofilament in a coil or meander configuration, by complex shaping steps, or may be produced by molding from synthetic resin materials such that the coupling heads are formed unitarily with bridges between successive heads, or such coupling heads may be stamped or otherwise formed from metal. Whatever the case with respect to fabrication of the coupling heads, for most purposes they are strung together in a chain either by being formed unitarily with the bridging elements or by being attached thereto.

Bridging elements generally are flexible and can be composed of synthetic resin material as already indicated or even can be cords onto which the coupling heads are molded or to which the heads may be secured, e.g. by clamping.

The fabrication of a chain of spaced-apart coupling heads ensures maintenance of the interhead spacing for further handling of the coupling chain as, for example, when the latter is to be applied to a flexible support.

Flexible supports of various types can be provided and, since the present invention is concerned with supports to which the coupling chains are attached by sewing, the present discussion will be confined to these.

For example, one type of support is a fabric tape along an edge of which the coupling chain may be stitched, this tape and row of coupling heads forming a so-called stringer half. Two such halves, positioned so that the rows of coupling heads can interdigitate and provided with a slider and end stop members, if desired, make up a slide fastener stringer.

However, it is frequently desirable to apply the coupling chains directly to two edges of a workpiece to be joined. For example, an opening in a fabric workpiece may have opposite edges provided directly with the coupling chains when it is inconvenient or uneconomical to sew respective stringer halves to the fabric workpiece or garment.

It is also desirable in other cases to attach the coupling chain directly to an edge of a flexible workpiece.

There are systems which have been developed for this purpose, e.g. as described in German patent documents DE-AS No. 23 26 421 and DE-OS No. 28 11 834, in which a sewing machine is utilized to attach the coupling element or chain to the fabric workpiece.

For the purposes of this discussion, the term "coupling chain" will be utilized to refer to a single row of coupling heads, interconnected or linked flexibly so that the spacing between these heads is substantially fixed and the entire row of heads can be fed to a stitching location for the attachment to the support by stitches formed at this location, e.g. via the multiple passes of a sewing machine needle which pierces the support between the coupling heads and then is retracted to permit advance of the workpiece and the coupling chain.

In general, these earlier systems operate at great speed utilizing a common feeder or transport for the fabric and the coupling chain. For example, this feeder may be the fabric feed dogs of the sewing machine beneath the stitching plate.

The support provided with a coupling chain in this manner and by these devices, however, is found to develop undulations or corrugations which result apparently from uncontrolled differences in the tensioning or movements of the fabric and the coupling chain. Frequently these defects develop or are noticeable only after the garment, workpiece or other structure produced by attaching the coupling chain to the support has been subjected to a subsequent treatment.

OBJECTS OF THE INVENTION

It is the principal object of the present invention to provide an improved method of affixing a coupling chain to a flexible support whereby the disadvantages of earlier techniques can be obviated.

Another object of this invention is to provide a method of attaching a coupling chain to a flexible workpiece whereby the two elements upon attachment are free from differential stress, i.e. are not subject to different tensions so that undulation, corrugation, shirring, pleating or bunching of one of the elements relative to the other does not occur.

Still another object of the invention is to provide a method of and an apparatus for the attachment of coupling chains to supports in the formation of slide fasteners so that flat, uniform products are produced.

SUMMARY OF THE INVENTION

These objects and others which will become apparent hereinafter are attained in accordance wih the invention in a method of applying at least one coupling chain to a support which comprises advancing the support along a sewing machine worktable by a first feed mechanism, advancing a coupling chain to and past said stitching location by a second feed mechanism being synchronously driven with a needle drive reciprocating a needle vertically at a stitching location to stitch a coupling chain to the support, and controlling at least one of the mechanisms to vary the increment of displacement thereof per stroke of the needle to ensure stress-free application of the coupling chain to the support such that at least, after treatment of the resulting product, the latter will be free from such undulations or corrugations.

Advantageously, the rate of advance of the coupling chain is adjusted by varying its feed increment per stroke of the needle, i.e. the second mechanism is the adjustable mechanism, and after completion of the stitching operation, the two members sewn together lie flat against one another.

It has been found to be advantageous to utilize the conventional fabric feed dogs below the stitch plate of the sewing machine as the first mechanism for advancing the flexible support while the presser foot which bears upon the workpiece from above is formed with the second mechanism for advancing the coupling chain.

In this case only the increment of displacement of the coupling chain need be adjustable.

According to a feature of the invention, the presser foot is formed with a guide for feeding the coupling chain to the stitching location and is provided with means for severing the coupling chain and at predetermined locations as, for example, at the end of one slide fastener and before a slide fastener is to be applied to the next workpiece. It has been found to be advantageous to provide the sewing machine with two needles, each of which can sew a respective coupling chain onto the flexible support or onto respective flexible supports and, in this case, the cutting means can include two cutters although a common actuator is provided for them. Two coupling chains are, in this case, guided into contact with the support.

The presser foot can be provided, in addition, with a transport foot coupled to a mechanism which provides an up-and-down and a back-and-forth movement to the transport foot so that the incremental displacement of the coupling chain or chains can be effected by the transport foot which, preferably, has formations engaging between the heads during the downward movement of the foot to ensure positive entrainment of the coupling chains. Since the coupling chains are positively entrained and the fabric feed is substantially positive by reason of the toothed contours of the dogs, the synchronism of the two with the needle ensures a stress-free attachment of the coupling chains to the support so that wrinkling of the support is excluded.

The downward movement of the foot is associated by a forward movement thereof to advance the coupling chains while an upward movement of the transport foot can be associated with a return movement.

The pressure foot can be biased against the fabric by the usual spring force utilized on presser feet of conventional sewing machines.

The adjustment of the feed of the coupling chain should be such that the differential stresses are excluded not only after the sewing operation is complete but also after other treatments to which the workpiece may be subjected, e.g. mangle-type ironing, washing or the like.

Obviously the adjustability of the chain-feed increment also allows the system to be accommodated to various materials and stitching patterns and the system is applicable not only to exposed slide fasteners but to concealed slide fasteners in which the coupling chain is at least in part shielded by a fold in fabric.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
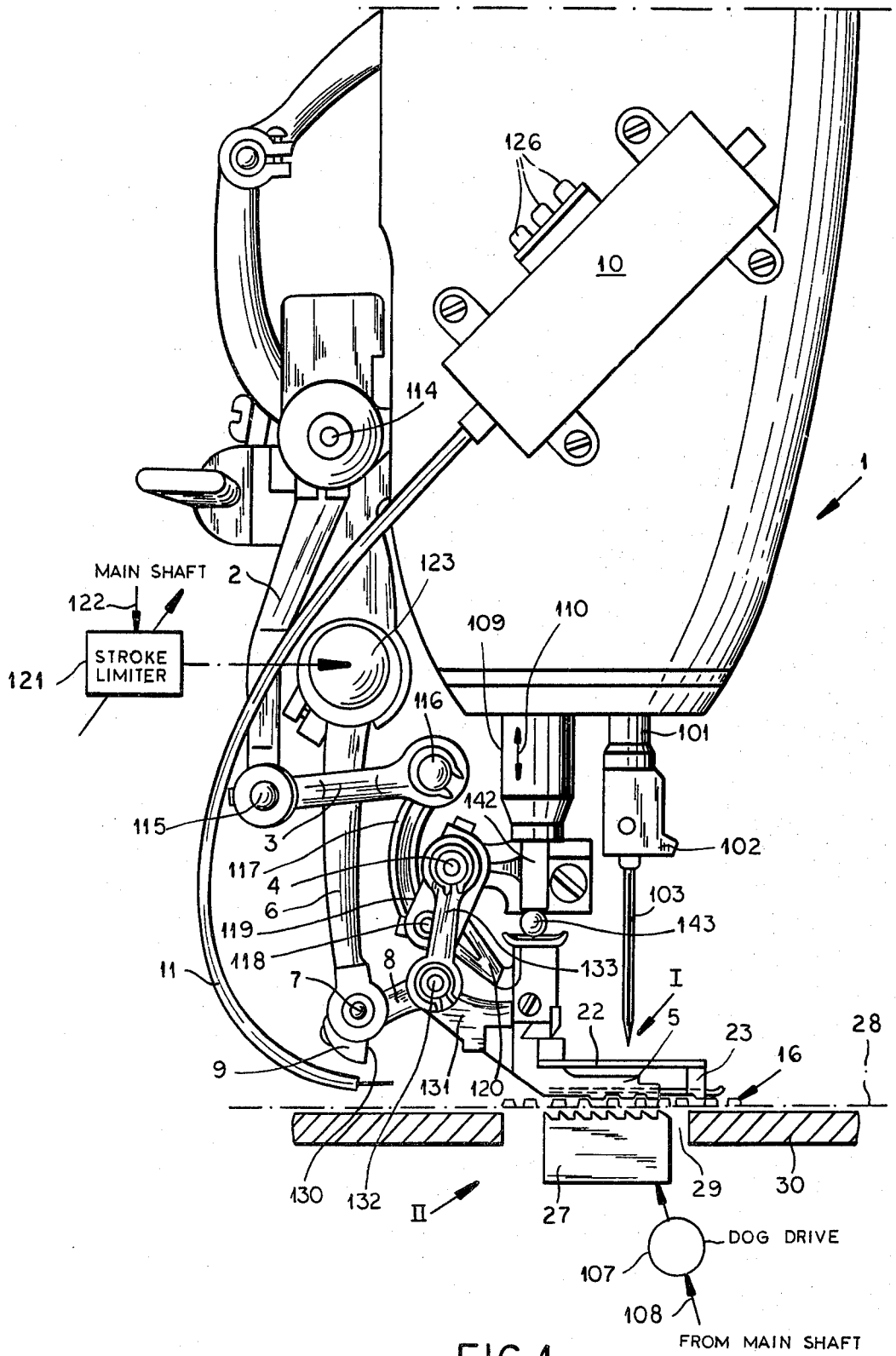
FIG. 1 is an elevational view, partly broken away and partly in diagrammatic form of the feed mechanisms of the invention, portions of the presser foot being omitted in FIG. 1 to show the transport foot in full side elevation.
Figure 9:
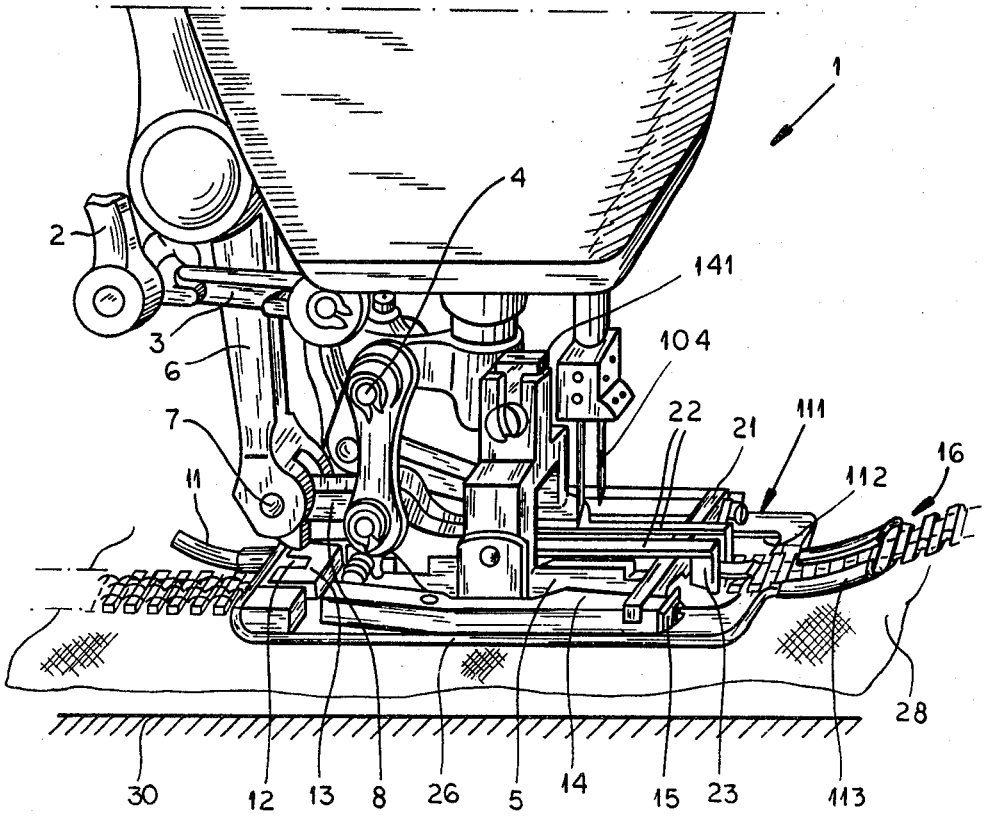
FIG. 9 is a perspective view of the sewing location in which certain parts have again been illustrated somewhat diagrammatically or partly broken away to enhance clarity.

FIG. 1 shows a sewing machine head 1 which can be assumed to lie at the free end of a conventional sewing machine arm, the other end of which is supported on a post which can include a drive mechanism transmitting the power of an electrical motor and a hand wheel to the main shaft (arm shaft) of the machine which drives a cam to vertically reciprocate a needle bar 101 provided with a holder 102 for a pair of needles 103, 104 (compare FIGS. 1 and 9).

The needles are fed with respective upper threads adapted to be stitched over the coupling heads of respective coupling chains 16, each of which can have a plurality of heads 105 (see FIG. 6) interconnected at 106.

In the operation illustrated in the drawing, two coupling chains 16 in interdigitated form are simultaneously applied to a fabric workpiece 28 overlying the worktable or stitch plate 30 of the machine. Each needle passes between each pair of successive heads 105 of the respective coupling chain to sew the coupling chains to the fabric 28.

Variations, of course, are possible in the sense that only a single coupling chain can be applied in which case a single-needle sewing machine can be provided. Two coupling chains can be applied simultaneously to juxtaposed edges of the two different workpieces, in which case, the two workpieces can be simultaneously advanced by a pair of dogs 27 which are displaced with a somewhat elliptical movement characteristic of the fabric feed dogs of conventional sewing machines. Only one such dog has been illustrated in the drawing.

As is conventional for such sewing machines, the dog 27 is driven by a shaft beneath the table 30 and coupled with the main or arm shaft so that the dog 27 operates synchronously with the needle bar 101. This fabric-feed mechanism, represented at II can include the dog drive diagrammatically indicated at 107 which is connected to the main shaft as represented at 108.

The head of the sewing machine also includes a downwardly biased spring-loaded presser-foot rod 109 which can be lifted by a lever on the back of the arm as is conventional, to enable the fabric to be placed over the dog 27 and beneath the needle. When this lever is lowered, the presser foot rod 109 is biased downwardly but nevertheless can yield against the spring force so that it is capable of movement as represented by the arrow 110.

The presser foot 111 comprises a frame having a central opening through which a transport foot is effective to step the coupling chains which are fed to the opening 112 in this frame via an arcuate guide 113. The transport foot forms part of a feed mechanism for the coupling chains as will be described in greater detail below.

The main shaft is formed with an eccentric or cam which acts upon an arm 2 so that the latter is swingable about the pivot 114, the arm 2 effecting up-and-down movement of the transport foot 5.

The arm 2 has a lower extremity connected by the pivot 115 to a link 3 which is articulated at 116 to a lever 117 fulcrumed at 118 to a plate 119 forming an eccentric with a pin 4 which rotates with the plate 119. The latter is coupled by the lever arm 120 with the transport foot 5. The mechanisms 2 through 4, therefore, can raise and lower the transport foot 5.

More particularly, a clockwise rotation of the lever 2 about the pivot 114 will shift link 3 to the left and rotate the lever 117, 120 in the counterclockwise sense to raise the transport foot 5, lowering of the latter resulting from displacement of the arm 2 in the opposite sense.

In the region of the hand wheel the main shaft is formed by an eccentric with an adjustable throw, the adjustability of this throw being represented by the unit 121 which is driven by the main shaft as indicated by the line 122. This eccentric acts via a pull rod upon a lever 6 which can be swung about its pivot 123 to effect the advance of the coupling chains.

At the lower end the lever 6 is formed with a pivot eye 7 which is swingably connected to a link 8 and is formed with a downwardly extending projection 9. On the head of the machine, moreover, I have mounted a solenoid 10 which displaces the core 124 of a bowden cable 11 and controls a pawl 12 which is pivotally mounted in a slidable wedging member 13 by the pivot pin 127.

The presser foot 111 is formed with a pair of levers 14 which are pivotally connected to the frame 26 at 128 and have their ends remote from the wedging member 13 formed with blades 15 adapted to cut through the bridges between the coupling heads of the coupling chains to sever a length of each coupling chain from the remainder thereof arriving at the guide 113.

At their ends, the levers 14 are formed with camming surfaces 17 and 18 respectively inclined to the direction of displacement of the wedging member 13 and parallel to this displacement.

A coil spring 24 engages the levers 14 so as to bias them in opposite senses tending to withdraw the blades 15 from engagement with the coupling chains.

Figure 3:
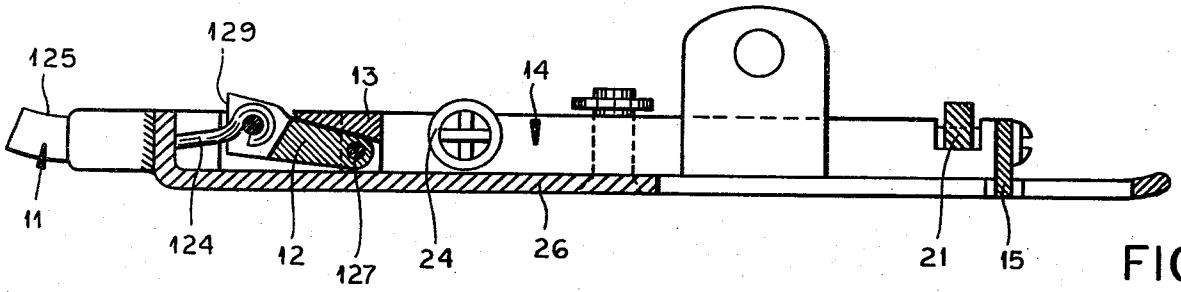
FIG. 3 is a longitudinal section through the presser foot plate of FIG. 2 taken along the line III—III thereof.

When the pawl 12 is lifted (FIG. 3) its trailing edge 129 is engageable by the forwardly facing flank 130 of the projecting 9 as this projection swings forwardly to drive member 13 between the levers 14 and swing the blades 15 inwardly.

When the solenoid 10 applies tension to the core 124 of the bowden cable 11, however, the pawl 12 is swung downwardly (see FIG. 5) and cannot be engaged by the projection 9.

The link 8 is connected to a rearwardly extending spur 131 of the transport foot 5 at a pivot 132 which is connected by a link 133 to the eccentric 4.

Figure 8:
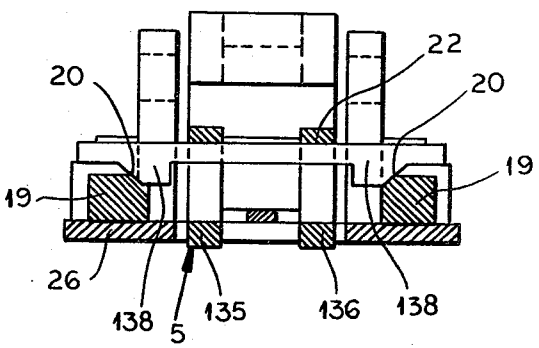
FIG. 8 is a section along the line VIII—VIII of FIG. 2.

As can be seen from FIGS. 6 through 8, the transport foot 5 is provided with a pair of members 135, 136, directly below a pair of leaf springs 22 and having formations 25 on their undersides to form-fittingly engage the coupling heads of the respective coupling chains. The leaf springs 22 are, in turn, provided with fingers 23, the function of which will be described subsequently and which also serve to engage into the interstices between coupling heads of severed ends of the chains. The leaf springs 22 overlie a bar 21 having a pair of formations 138 which have flanks 20 engageable by camming flanks of the lever arms 19 of members 14 as these arms swing inwardly to lift the leaf springs 22. These camming formations of the lever arms 19 are represented at 139 in FIG. 2.

A pair of lugs 140 on the presser foot connect the latter pivotally via a yoke 141 to the presser foot rod 109. Within this presser foot rod 109 is a vertically displaceable spring-loaded rod 142 against which the transport foot 5 rests via a ball 143 allowing the up-and-down and back-and-forth movements previously described.

In operation, the presser foot is lifted and the fabric 28 placed on the worktable in appropriate position and coupling chains 16 are fed through the guide 113 to the stitching location. The presser foot is then lowered and machine operation commences. For each pass of the needles 104 between a pair of coupling heads and through the fabric to form a stitch, the underthread from a bobbin mechanism (not shown) below the table, cooperates with the upper thread and the latter is drawn over the coupling head upon withdrawal of the needles and advance of the fabric by the dog 27 through a distance corresponding to the stitch length. Synchronously, the transport foot 5 is displaced in the direction of arrow 144 to entrain the coupling chains through a corresponding increment (one stitch length) the presser foot 5 then raising, returning in the opposite direction and lowering to reengage the coupling chains. The raising and lowering motion is effected in the manner described by the swinging of arm 2 while the advance and return movement is effected by the swinging of arm 6.

When a predetermined length of coupling elements has been stitched to the fabric, the reversible solenoid 10 is operated to elevate the pawl 12 so that on the next return stroke of the foot 5, the projection 10 engages this pawl and drives the wedge member 13 between the levers 14.

The blades 15 swing between coupling members of the respective chains 16 and sever the applied length from the oncoming length of coupling chain.

After rapidly swinging these levers inwardly by engagement with the inclined surfaces 17, the wedge 13 rides along the parallel surfaces 18 so that the cutting position (FIG. 2) can be retained without further energization of the solenoid or further magnetic force. Naturally, in the extreme right-hand position, the projection 9 no longer engages the pawl 12.

Figure 6:
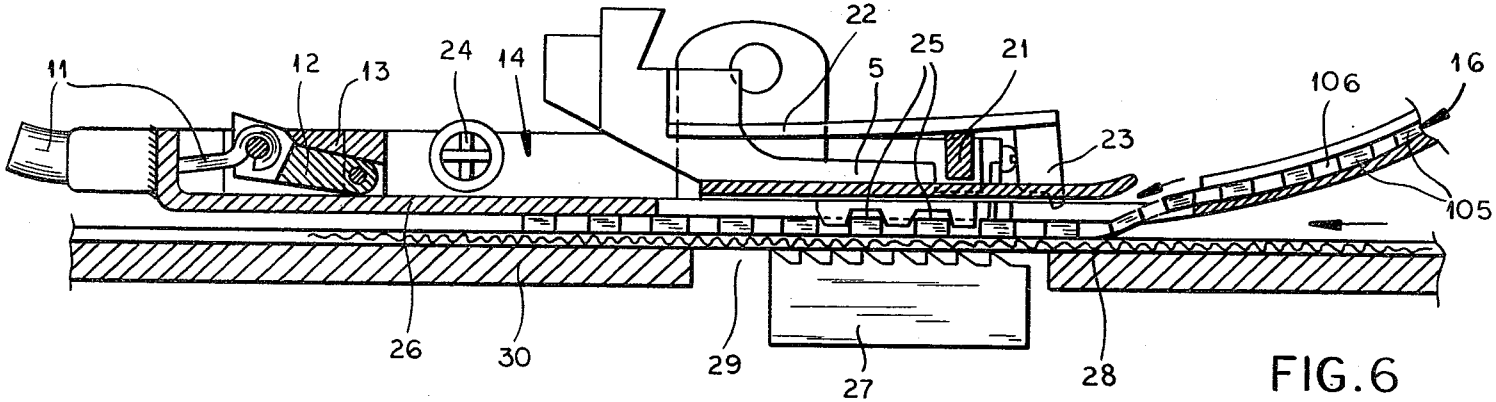
FIG. 6 is a view similar to FIG. 5 showing the parts in another operative position.
Figure 7:
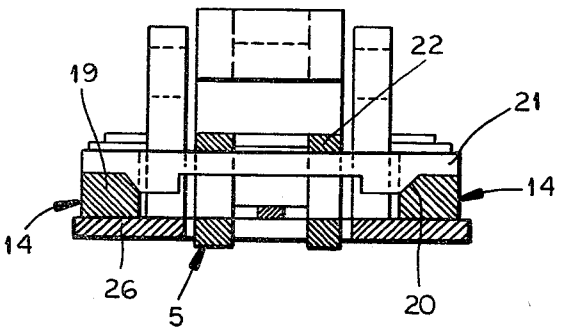
FIG. 7 is a section along the line VII—VII of FIG. 4.

FIG. 6 shows the position during the last transport stroke prior to a cutting operation. The pawl 12 is in its upper position ready to be engaged by the projection 9. In the next quarter cycle upon lifting of the foot 5, the projection 9 is lifted to clear the pawl 12 and then drops down so that in the following quarter cycle the projection 9 engages the pawl 12 to trigger the cutting operation in the manner described.

Figure 2:
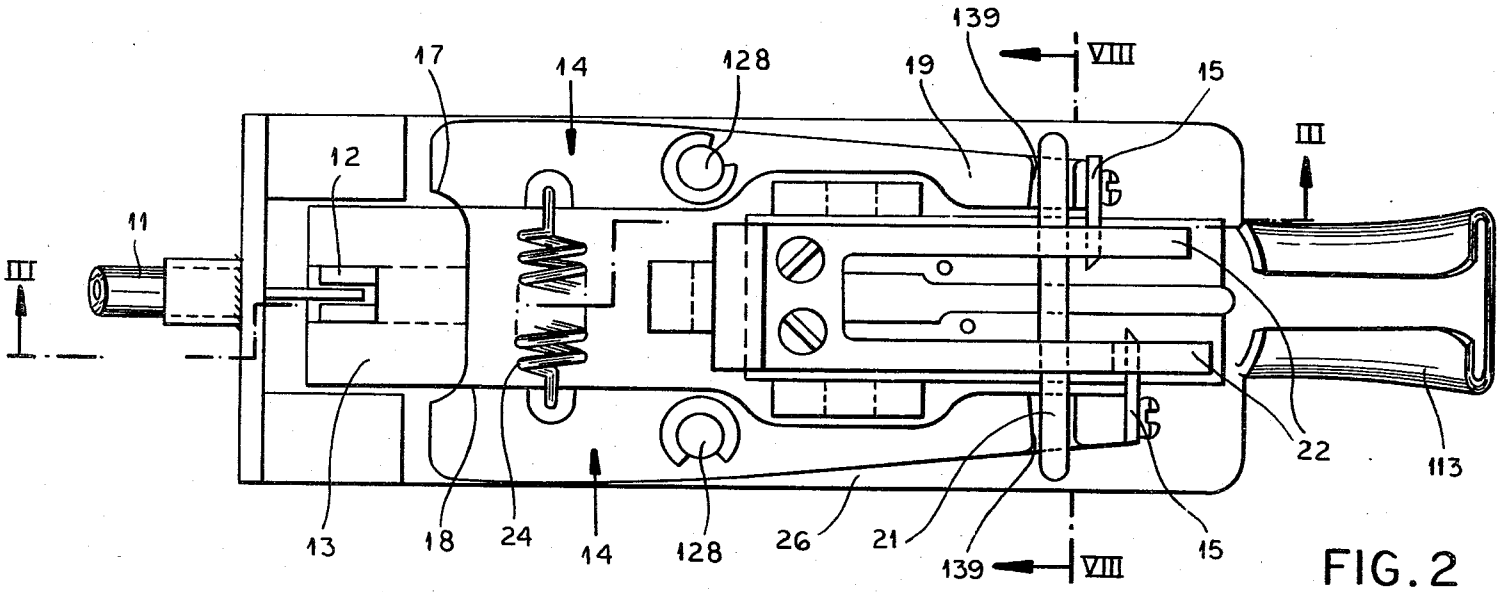
FIG. 2 is a plan view of the presser foot plate greatly enlarged in scale by comparison to FIG. 1.
Figure 4:
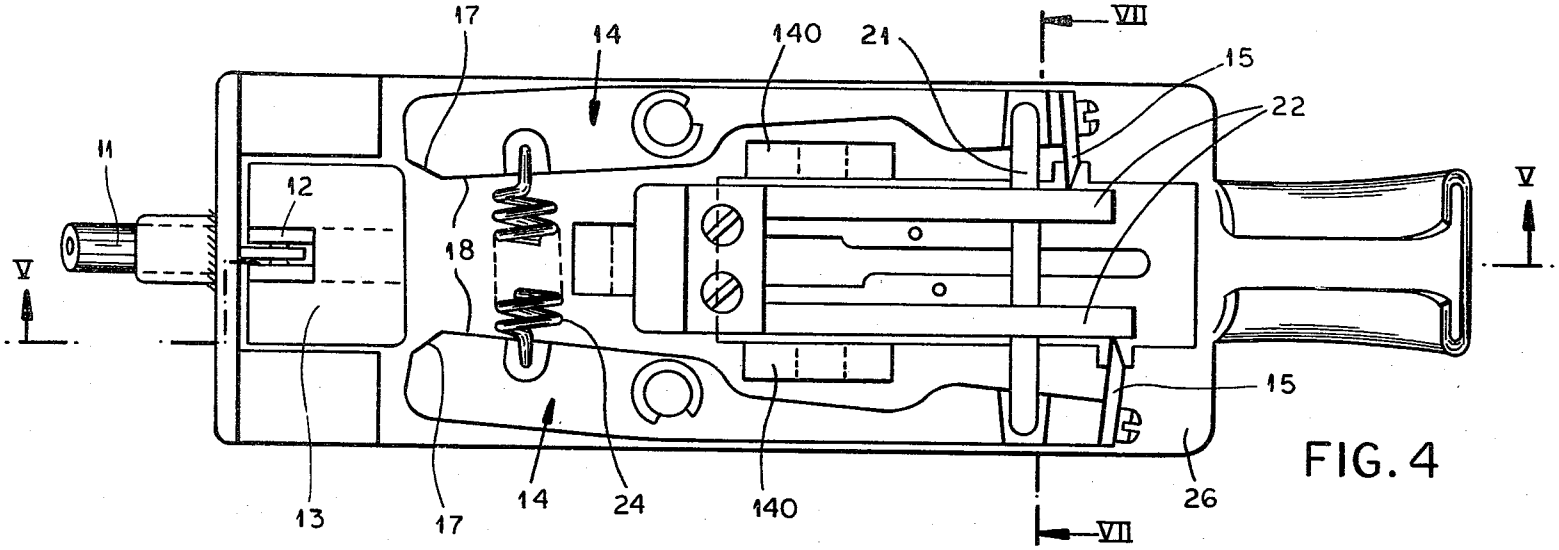
FIG. 4 is a view similar to FIG. 2 but showing the parts of the presser foot in another operative position.
Figure 5:
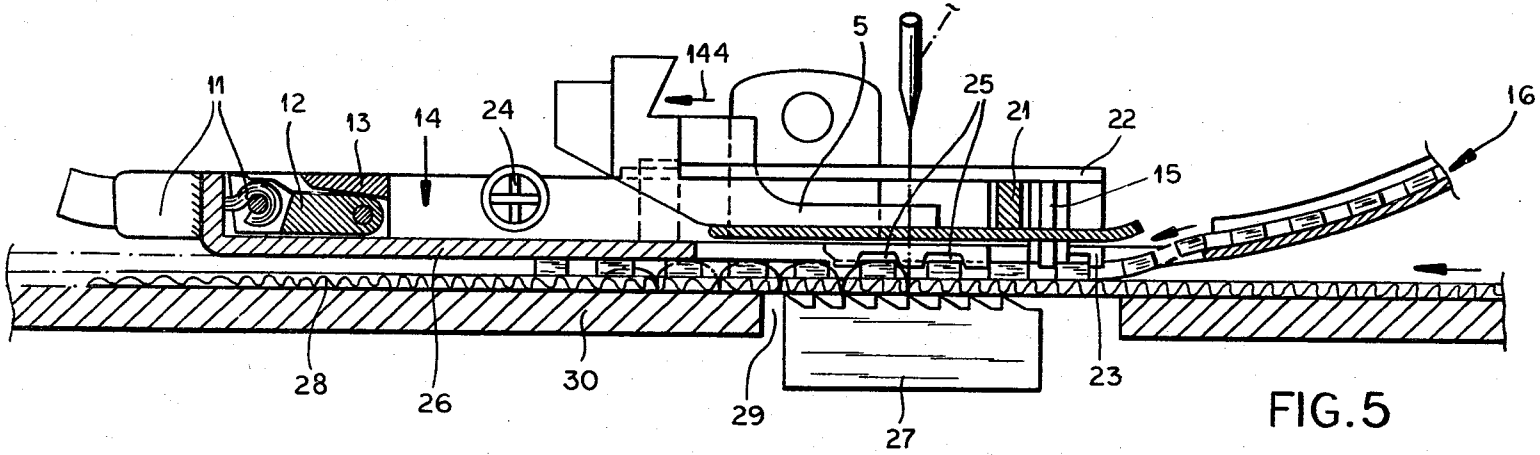
FIG. 5 is a longitudinal section through the presser foot plate of FIG. 4 taken along the line V—V thereof and showing the feed of a coupling chain to a fabric workpiece.

The inward swing of the arms 19 of the levers 14, cams the leaf springs 22 upwardly to disengage their teeth 23 from the coupling chains. FIGS. 4, 5 and 7 show the position of these elements during stitching of the coupling elements to the fabric while FIGS. 2, 6 and 8 show the position at cutting.

During the next clockwise movement of lever 6, the solenoid 10 is reversed to drop the pawl 12 (FIG. 5) and retract the member 13 from between the levers 14, enabling the spring 24 to return these levers to their original positions (FIG. 4) withdrawing the blades 15 and allowing the bar 21 to drop and bring the teeth 23 into engagement with the coupling chains.

One of the advantages of the system of the invention is that the cutting operation depends solely on the feed mechanism so that it is always synchronized with the sewing of the coupling chains onto the fabric in spite of the fact that the signals for operating the solenoid cannot always be synchronized with the rotation of the main drive shaft because of the speed thereof.

Members 135 and 136 can be resilient fingers and it has been found to be advantageous to provide resilient fingers on the stitch plate as well to retain the coupling elements against slipping. When only the coupling chain is to be sewn in place, a filling body can be inserted in the guide 113 and utilized to prevent lateral displacement of the coupling chain.

Member 121 is adjusted so that the feed increment of the mechanism I is such that the coupling chain and the fabric will lie flat one against another after completion of the stitching operation or after washing or ironing of the product. The lower drive 107 can be adjustable as well.

I claim:

1. A method of securing a slide fastener coupling chain to a flexible support, comprising the steps of:

(a) incrementally advancing said support past a stitching location;

(b) feeding said coupling chain to said support and said stitching location and incrementally advancing said coupling chain past said location;

(c) sewing said coupling chain to said support at said location by repeatedly passing a sewing needle between coupling heads of said chain and through said support at said location synchronously with the increment feeds of said support and said coupling chain; and (d) controlling the displacement per increment of feed of at least one of said incremental feeds to ensure flat, corrugation-free contact of the coupling chain with the support to which it is stitched at least after washing or ironing treatment thereof.

2. The method defined in claim 1 wherein the displacement increment of said coupling chain feed is controlled.

3. The method defined in claim 2 wherein said support is advanced along a worktable past said location by a fabric-feed dog from below and said coupling chain is advanced above said support by engaging it with a transport foot, said method comprising imparting to said transport foot a composite up-and-down and back-and-forth movement.

4. The method defined in claim 3, further comprising the step of, upon attachment of a predetermined length of coupling chain to said support, severing said coupling chain from an incoming length thereof fed to said location.

5. The method defined in claim 4 wherein the displacement of said transport foot actuates a blade for cutting said coupling chain.

6. An apparatus for sewing a coupling chain to a flexible support comprising:

a sewing machine table provided with a fabric-feed mechanism for advancing said support past a stitching location;

a sewing machine head overhanging said table and provided with reciprocatable needle bar displacing a needle through said support at said location in synchronism with said mechanism;

a biased presser foot mounted on said head and riding on said support at said location;

a transport foot on said presser foot engageable with a coupling chain for advancing same past said location for stitching of said coupling chain to said support by said needle;

a chain-feed mechanism synchronized with said needle bar for incrementally displacing said chain past said location;

and control means operatively connected to one of said mechanisms for varying the displacement increment thereof to ensure flat contact of said chain and said support upon the stitching of said chain to said support.

7. The apparatus defined in claim 6 wherein said transport foot is provided with formations engaging in said chain between coupling heads thereof.

8. The apparatus defined in claim 6 wherein said presser foot is formed with a lever having a blade and is swingable to engage and cut said chain, and means operable by said chain-feed mechanism for actuating said lever.

9. The apparatus defined in claim 8 wherein the last-mentioned means includes a reversible solenoid mounted on said head and having a bowden cable, a wedge member on said presser foot being formed with a pawl displaceable by said bowden cable, said chain-feed mechanism including a projection engageable with said pawl for displacing same to actuate said lever.

10. The apparatus defined in claim 8 wherein said chain-feed mechanism includes lever and linkage means for imparting a composite up-and-down and back-and-forth movement to said transport foot.

* * * * *